US005728660A

United States Patent [19]

Borah

[11] Patent Number: 5,728,660

[45] Date of Patent: Mar. 17, 1998

[54] EXTRACTION FLUIDS FOR REMOVAL OF CONTAMINANTS FROM SURFACES

[75] Inventor: Ronald E. Borah, Chesterton, Ind.

[73] Assignee: EET, Inc., Bellaire, Tex.

[21] Appl. No.: 711,397

[22] Filed: Sep. 6, 1996

Related U.S. Application Data

[63] Continuation of Ser. No. 222,469, Apr. 4, 1994, abandoned, which is a continuation-in-part of Ser. No. 43,435, Apr. 5, 1993, Pat. No. 5,421,906.

[51] Int. Cl.[6] ..... C11D 3/30

[52] U.S. Cl. ..... 510/110; 510/499

[58] Field of Search ..... 510/110, 499, 510/506

[56] References Cited

U.S. PATENT DOCUMENTS

| | | | |
|---|---|---|---|
| H269 | 5/1987 | Malik | 422/37 |
| 3,437,521 | 4/1969 | Buist et al. | 134/26 |
| 3,655,569 | 4/1972 | Hellsten et al. | 252/99 |
| 3,832,234 | 8/1974 | Otrhalek et al. | 134/4 |
| 3,882,038 | 5/1975 | Clayton et al. | 252/164 |
| 3,957,529 | 5/1976 | Alexander et al. | 134/3 |
| 4,032,466 | 6/1977 | Otrhalek et al. | 252/136 |
| 4,040,866 | 8/1977 | Mondshine | 134/26 |
| 4,174,290 | 11/1979 | Leveskis | 252/142 |
| 4,376,069 | 3/1983 | Maggi | 252/542 |
| 4,390,465 | 6/1983 | Spekman, Jr. | 252/527 |
| 4,410,396 | 10/1983 | Somers et al. | 156/664 |
| 4,430,128 | 2/1984 | Frenier et al. | 134/3 |
| 4,439,339 | 3/1984 | Doumit | 252/80 |
| 4,472,205 | 9/1984 | Cortner | 134/27 |
| 4,541,945 | 9/1985 | Anderson et al. | 252/149 |
| 4,640,719 | 2/1987 | Hayes et al. | 134/40 |
| 4,666,528 | 5/1987 | Arrington et al. | 134/2 |
| 4,676,920 | 6/1987 | Culshaw | 52/163 |
| 4,749,508 | 6/1988 | Cockrell, Jr. et al. | 252/136 |
| 4,762,638 | 8/1988 | Dollman et al. | 252/135 |
| 4,767,563 | 8/1988 | de Buzzaccarini | 252/174.25 |
| 4,792,413 | 12/1988 | Nash et al. | 252/111 |
| 4,877,459 | 10/1989 | Cockrell, Jr. et al. | 134/40 |
| 4,966,724 | 10/1990 | Culshaw et al. | 252/188 |
| 5,102,573 | 4/1992 | Han et al. | 252/253 |
| 5,122,194 | 6/1992 | Miller et al. | 134/29 |
| 5,202,050 | 4/1993 | Culshaw et al. | 252/170 |
| 5,205,960 | 4/1993 | Kristopeit et al. | 252/174.24 |
| 5,254,290 | 10/1993 | Blandiaux et al. | 252/545 |
| 5,290,472 | 3/1994 | Michael | 252/170 |

OTHER PUBLICATIONS

McCutcheon's Emulsifiers & Detergents, North American Edition 1982 p. 283.

Conner, Jesse R., "Chemical Fixation and Solidification of Hazardous Wastes," 1990, pp. 36–39; 43; 55; 380–381; and 533, no month available.

Adamson, Arthur W., "Physical Chemistry of Surfaces," 5th Ed., 1990, pp. 11; 101; 226–227; 229; 379; 421–422; 435; 442–443; 473; 493–495; 506–507; 514–516; 528; 531; and 571, no month available.

Rosen, Milton J., "Surfactants and Interfacial Phenomena," 2nd Ed., 1989, pp. 17–19; 31; 55–56; 150, 229; 255; 270–273; and 374–375 no month available.

Corbitt, Robert A., "Standard Handbook of Environmental Engineering," pp. 6.20; 9.6; 9.; 9.87; and 9.100, 1990.

Manaham, Stanley E., "Environmental Chemistry," 5th Ed., 1991, p–p. 5; 48–49; 57; 59; 67–68; 96–97; 162–163; 172–175; 198; 260–261; 415; 433–434; and 481, no month available.

Betz, pp. 112; 118–120.

"The Nalco Water Handbook," 2nd Ed., pp. 3.19; 11.1; 39.17.

*Primary Examiner*—Paul Lieberman
*Assistant Examiner*—John R. Hardee
*Attorney, Agent, or Firm*—Christensen O'Connor Johnson & Kindness PLLC

[57] ABSTRACT

A cleaning process and water-based cleaning compositions effective for the removal of radionuclides, polychlorinated biphenyls, pesticides, herbicides, and heavy metals from surfaces of all types, more especially porous surfaces, surfaces that contain irregularities and microscopic voids into which contaminants may migrate and lodge thereby creating a substrate below the surface that must also be cleaned, and particulate surfaces. The cleaning blends and processes remove contaminants from porous and irregular surfaces to such a depth below the surface and into the substrate, and to such an extent, that the cleaned surface satisfies current regulations promulgated by the EPA and NRC relating to standards for decontamination. The process also allows sealing of cleaned surfaces, if desired, with an impermeable coating of a synthetic polymeric composition in order to retard subsequent migration of any residual contaminants to the surface.

16 Claims, No Drawings

EXTRACTION FLUIDS FOR REMOVAL OF CONTAMINANTS FROM SURFACES

RELATED APPLICATIONS

This application is a continuation of U.S. Ser. No. 08/222,469, filed Apr. 4, 1994, now abandoned, which is a continuation-in-part of U.S. Ser. No. 08/043,435, filed Apr. 5, 1993, now U.S. Pat. No. 5,421,906.

BACKGROUND OF THE INVENTION

1. Field of the Invention

The invention is of a cleaning process and cleaning compositions effective for the extraction of contaminants including radionuclides, herbicides, pesticides, polychlorinated biphenyls (PCBs), and heavy metals from interior and exterior surfaces, including the substrate of such surfaces, and is most effective in cleaning difficult to clean surfaces such as porous surfaces, and irregular surfaces into which the contaminants may migrate and lodge, and surfaces of particulates. Cleaning is effected to such a depth below the surface and into the substrate and to such an extent that the cleaned surfaces do not pose an environmental or health hazard and meet current regulations promulgated by the Environmental Protection Agency (EPA) and Nuclear Regulatory Agency (NRC) relating to standards for decontamination.

2. Description of the Related Art

With the growth of industry, a significant amount of hazardous waste products and products formerly regarded as useful but now recognized as hazardous have entered the environment. These hazardous materials are frequently present as contaminants on surfaces of equipment, installations of all kinds, civil works, soil, and other like items.

For example, a significant amount of radioactive waste, in the form of radionuclides, is present in nuclear power plants, nuclear weapons production plants, mining and milling equipment used for uranium mining, and in apparatus in the medical area where radioactive isotopes are used. The presence of these radionuclides, which contaminate equipment including pumps, pipelines, valves, concrete foundations, and all other equipment and structures with which the radionuclides have come into contact, now pose a serious health problem since their radioactivity is known to be carcinogenic. To qualify as a decontaminated facility, depending upon the type of radioactivity, the NRC requires that the level of radioactivity from radionuclides be reduced to less than 5,000 disintegrations per minute (DPM) in some cases and other lower levels in other cases.

Polychlorinated biphenyls (PCBs) were once widely used industrial chemicals, especially as insulating or hydraulic fluids in electrical capacitors, transformers, vacuum pumps, gas-transmission turbines, machinery, and various other devices and products. Their chemical stability and non-flammability contributed to their commercial usefulness. However, it has since been found that PCBs are carcinogens and the United States Environmental Protection Agency (EPA) currently lists PCBs and any surfaces or equipment containing PCBs as hazardous. Consequently, these chemicals are no longer recommended or used in new applications. However, a large amount of existing capital equipment, installed before the listing of PCBs as hazardous, contains PCBs. These installations pose a hazard whenever a spillage of PCBs occurs thereby contaminating the surrounding area or whenever routine repairs expose workers or the environment to PCBs.

While it is desirable to remove PCBs and dispose of these in a suitable hazardous waste facility, PCBs are not easily removed from apparatus or spilled areas because of their capability to enter into the tiniest of pores and microscopic voids and spaces in surfaces with which they come into contact. For example, in transformers which frequently contain wood, paper, metal joints, and electrical components with minute crevices, the PCBs soak into pores and microscopic voids in the steel and concrete and fill the tiniest of microscopic spaces such as pores and microscopic voids, and the like, in metals. When PCBs have spilled onto a surface, such as a concrete surface, the PCBs over time will soak into pores and microscopic voids in the concrete and contaminate the concrete to well below the exposed surface. Current techniques that merely clean the surface of concrete that has been exposed to the PCBs for a long period of time are not able to adequately clean the surface and do not reach PCBs held in the substrate below the surface in the pores and microscopic voids. Moreover, once surface cleaning has been completed, PCBs leach from the pores and microscopic voids to the surface over time due to the effect of a concentration gradient. Thus, the surface becomes recontaminated and further cleaning is necessitated. Likewise, while the bulk of the PCBs can be readily drained from some PCB-containing equipment, the residual PCB contaminant in pores, microscopic voids, crevices, and joints is not easily removed. It is found that upon refilling the drained apparatus with a replacement fluid for PCBs, PCBs will continue to leach from surfaces of the apparatus into the replacement fluid thereby contaminating it and rendering it hazardous.

Likewise, heavy metals have been identified as hazardous to human health and the EPA requires their removal from environments where they pose a health hazard. Like PCBs and radionuclides, heavy metals have the capability to migrate into pores, joints, crevices, and microscopic voids in interior and exterior surfaces and thereby cause contamination in the substrate to well below the apparent surface of any apparatus, device, or ground surface with which they come into contact. Mere surface cleaning is therefore ineffective to remove heavy metals contamination from substrates.

Certain pesticides and herbicides are also now known to be hazardous to human health. These compositions contaminate surfaces and substrates, such as concrete, but more especially particulate surfaces, such as soil, clay, gravel, and the like.

There is a need for methods and cleaning compositions for the removal of contaminants including radionuclides, PCBs, herbicides, pesticides, and heavy metals from porous and non-porous interior and exterior surfaces, particulate surfaces, and surfaces having minute spaces, crevices, pores, or microscopic voids into which these contaminants migrate and from which they are not readily extractable. Further, the method and cleaning compositions should desirably not only extract these contaminants from well below the surface to be cleaned, but should extract these to such a level that any remaining contaminants do not pose a hazard, i.e., a surface and its substrate cleaned of PCBs would meet EPA regulations for reclassification from a hazardous to a non-hazardous material; a surface and its substrate cleaned of heavy metals, herbicides, or pesticides, would meet the EPA's TCLP standard setting the upper limit for their concentration; and a surface and its substrate cleaned of radionuclides would test at less than 5,000 DPM. The method and cleaning compositions should also desirably extract these contaminants without significant surface damage or scarring. Further, the method and cleaning compositions should desirably extract these contaminants with a minimum amount of hazardous waste byproduct which must be disposed of and, in the case of radionuclides, the byproduct waste should preferably be water soluble to assist in ease of disposal. Finally, cleaning compositions should desirably not be flammable.

SUMMARY OF THE INVENTION

The invention provides water-based, non-flammable cleaning compositions and methods for applying these compositions for the extraction of contaminants such as radionuclides, herbicides, pesticides, polychlorinated biphenyls (PCBs), heavy metals, and other hazardous compositions including those listed as hazardous under the U.S. EPA's TCLP standard, or mixtures thereof, from surfaces and substrates of all kinds. While the invention cleans smooth surfaces easily, it is especially useful in cleaning hard to clean surfaces and substrates, such as substrates having porous surfaces, and surfaces with irregularities or microscopic voids. The invention also cleans particulate surfaces and the particulates. While it is usually difficult, if not impossible, using prior art techniques to remove these contaminants to acceptable regulatory levels from these hard to clean surfaces, particularly where the contaminants have remained on the surface for long periods of time thereby permitting deep migration of the contaminants into the substrate, the invention cleaning compositions and processes are particularly effective for removing contaminants from these surfaces and their substrates.

Generally, "porous surfaces" include steel (including stainless steel, mild steel, and galvanized steel) cast iron, concrete, brick, wood, and the like. "Surfaces with irregularities" include surfaces that are not porous in the conventional sense but that contain minute spaces, crevices, pores, microscopic voids, numerous capillaries, surface irregularities, and restricted spaces into which the contaminants migrate and lodge and thereby create a contaminated substrate below the surface that must also be cleaned. The invention also cleans contaminants from surfaces of particulates, such as sand, clay, gravel, and the like.

The invention cleaning fluids and processes are effective in removing contaminants from surfaces and their substrates and providing a cleaned surface that meets the standards currently set by the U.S. EPA. The term "contaminants" as used in the specification and claims encompasses radionuclides, PCBs, herbicides, pesticides, heavy metals, including, without limitation, all those materials and compositions listed as hazardous and that have the characteristic of toxicity under 40 C.F.R §261.24 (Table 1) (Revised as of July 1992 and hereby incorporated by reference as if fully set forth herein), and like compositions, and also materials that pose an undesirable contaminant and that desirably must be reduced in concentration to an acceptable level.

The invention cleaning fluids and processes are capable of extracting contaminants from beneath porous surfaces and the substrate, without significant surface destruction. As a result, the cleaned surface is able to meet current regulatory standards for delisting. Since the process does not require the shaving, scarring, or scabbling of the surface to be cleaned as in prior art techniques, the surface is not substantially damaged or scarred. This is particularly advantageous in the cleaning of contaminated structural equipment, supporting foundations, or equipment to be reused.

The invention process requires at least two stages, and optionally three stages: a first optional preflush stage followed by a precleaning stage to prepare the surface to be cleaned and solubilize contaminants; followed by a cleaning or extraction stage for removing the contaminants from the surface. The precleaning stage utilizes a precleaning composition, a blend of chemicals, to initially scrub the surface and remove surface contaminants and dirt. This composition is left to dwell on the surface for a period of time in the case of some contaminants, such as radionuclides, or when the surface is of concrete. Thereafter, the surface is rinsed with water substantially free of polyvalent cations. Alternatively, a preferred rinsing solution is a solution of 4–8 wt. % sodium citrate in distilled water or other water substantially free of ions. A more preferred rinsing solution includes about 20 wt. % nitric acid (58% strength) and a non-ionic surfactant in deionized water. This nitric acid rinse may optionally and preferably also include about 10 wt. % of a phosphate acid ester. The precleaning scrubbing and rinsing steps are repeated, as needed. After each precleaning, the precleaned surface is vacuumed to remove fluid and debris as far as possible and thereby remove contaminants. Also, after each rinsing, the surface is vacuumed to remove the rinse fluid with contaminants. After rinsing and vacuuming, the extraction stage, utilizing an extraction composition that is also a blend of chemicals, is applied by scrubbing the surface, allowing the extraction composition to dwell on the surface for a period of time. Thereafter, the surface is rinsed with substantially ion-free water or rinse fluids described above. Fluids on the surface are again removed by vacuuming to remove the rinse fluid with contaminants. The application of the extraction composition, rinsing, and vacuuming may be repeated several times before a longer dwell time of the extraction composition on the surface. This dwell time may include an overnight or weekend dwell, if necessary, followed by rinsing with substantially ion-free water, or a solution of sodium citrate in substantially ion-free water or a solution of about 20 wt. % nitric acid (58%), about 10 wt. % phosphate acid ester, and a non-ionic surfactant in substantially ion-free water. The rinse solution is preferably also removed from the surface by vacuuming to remove the fluid with contaminants.

In certain instances, such as when the contaminant to be removed includes PCBs, organics, pesticides, radionuclides, or heavy metals, an optional preflush step may be carried out in order to improve subsequent extraction. In this preflush step, a chemical formulation is utilized to prepare the surface before the precleaning step. The preflush solution is also waterbased and has a pH in the acid range.

The basic cycle of precleaning by scrubbing on precleaning fluid, allowing the precleaning fluid to dwell for a certain time, as needed, and then rinsing followed by vacuuming, the applying of extraction fluid, dwelling of extraction fluid on the surface, rinsing of extraction fluid from the surface, vacuuming, followed by at least one longer dwelling of the extraction fluid on the surface, rinsing and vacuuming are repeated until the desired level of residual contaminants as dictated by the EPA regulations or other requirements (if not regulated by the EPA) are obtained. Optionally, after extraction, chemicals may be applied to the surface to encapsulate the surface. Such chemicals include, for example, the liquid silicates. Optionally, this may be followed by applying a synthetic polymeric composition to form an impermeable barrier over the surface. Such coatings are produced, for example, by applying liquid polyurethane solutions by spraying or brushing onto the surface to be coated and sealed.

The preflush, precleaning and extraction blends are waterbased. To avoid interference from ions normally present in typical water supplies, it is preferred that the water used in making the preflush, precleaning and extraction blends be distilled, deionized, or demineralized in order to remove or significantly reduce the ion content of the water.

The cleaning compositions utilized are not flammable and the waste generated during cleaning generally constitutes less than about 7–8 gallons/100 $ft^2$ of surface cleaned. Therefore, waste disposal costs are minimized.

The invention cleaning process and cleaning compositions can reduce PCB contamination to less than 10 micrograms per 100 square centimeters (10 μg/100 $cm^2$) of treated surface or "non-detectable," i.e., 0.2 μg/100 $cm^2$, so that the cleaned apparatus, structure, or other previously contaminated surface, may be reclassified under EPA regulations from a hazardous material to a non-hazardous material. Similarly, heavy metals are removed to a surface concentration of less than current EPA TCLP regulatory levels (40 C.F.R. §261.24 as revised Jul. 1, 1992) for each of the listed heavy metals; and radionuclides can be reduced to surface concentrations of less than about 5,000 DPM (disintegrations per minute), less than about 2,000 DPM in some cases, or to a non-detection limit, in other cases. Herbicide and pesticide levels are reduced to a surface concentration of less than current EPA TCLP regulatory levels for each of the listed herbicides and pesticides.

As a result of the invention's low level of residual contamination and deep cleaning, to a significant depth below the surface and into its substrate, the cleaned equipment or structures may be reclassified (under current federal regulations) as a non-hazardous substance, or disposed of as non-hazardous or reclassified for reuse or resale.

DETAILED DESCRIPTION OF THE PREFERRED EMBODIMENTS

The invention provides a cleaning process and cleaning fluid blends for removing contaminants such as, for example, radionuclides, herbicides, pesticides, PCBs, and heavy metals from interior and exterior surfaces of all types, including the substrates of such surfaces. The invention is particularly effective for removing contaminants from porous surfaces and surfaces that are conventionally regarded as non-porous but that may contain minute spaces, crevices, pores, microscopic voids, or other surface irregularities and restricted spaces into which these contaminants migrate and lodge and thereby create a substrate below the surface that must also be cleaned. For simplicity, these latter "conventionally non-porous" surfaces are hereinafter referred to as "surfaces with irregularities" or "surface irregularities." The invention removes the contaminants from porous materials and surfaces with irregularities to a significant depth beneath the surface so that current regulatory standards for decontamination are substantially achieved. Thereafter, the surfaces may be sealed with liquid silicates and then with a coating of a synthetic polymeric composition, such as with a polyurethane coating in order to retard subsequent migration of the contaminants. The invention process and cleaning fluids can also be used to remove contaminants from particulates such as sand, clay, gravel, and the like.

It has been found that roughening the contaminated surface before the application of chemical treating fluids results in an increased penetration of the fluids into the surface thereby facilitating cleaning. In general, the surface roughening may be carried out by roughening with sand paper, steel wool, or other abrasive that will operate upon the surface to produce sufficient roughening to aid penetration of fluids into the surface.

The invention process and cleaning fluids can decontaminate radionuclide contaminated materials to less than the NRC-required 5,000 DPM (disintegrations per minute) standard. Heavy metals-contaminated materials and herbicide or pesticide-contaminated materials can be cleaned to meet or better the EPA's current TCLP standards. The invention process and cleaning fluids can also produce surfaces decontaminated of PCBs that meet current EPA standards: less than 10 micrograms/100 $cm^2$ to allow reclassification from a hazardous material to a non-hazardous material; and 0.2 micrograms/100 $cm^2$ to allow reuse or resale of PCB-decontaminated articles.

The invention cleaning blends are water-based and, to prevent interference from ions normally present in a typical water supply, it is preferred that the water be distilled, deionized, or demineralized to remove interfering ions and provide substantially ion-free water. As a precaution, it is also recommended that any rinsing or washing with water should likewise be carried out with water that is substantially ion-free.

The Process for Removing Contaminants

While not wishing to be bound by any theory, it is hypothesized that the invention process and cleaning compositions may perform their function by interaction of basic electro-chemical processes. Contaminants migrate into the surface and penetrate the substrate to electrostatically bond to it. Contaminated surfaces are usually negatively charged. Therefore, the positive ion-containing cleaning solutions are attracted to the surface by electrostatic effects and attracted into pores and microscopic voids and crevices by both electrochemical effects and electrocapillary forces. Further, the cations in the extraction solutions react electrochemically with contaminants to solubilize, or leach out the contaminants.

a. Smooth Surfaces or Irregular Surfaces

Before applying the precleaning solution to a smooth surface or a surface with irregularities, it is preferred that the contaminated surface should be swept, vacuumed, or lightly scraped to remove any loose surface debris, dirt, and the like. It has also been found that roughening the surface to be treated with an abrasive, such as sand paper, steel wool, and the like, facilitates the penetration of the fluids according to the invention into the surface thereby enhancing cleaning of the surface.

As an optional step, when the contaminant to be removed includes PCBs, organics, pesticides, radionuclides, or heavy metals, the surface may be treated with a preflush solution before the application of the precleaning solution. In general, it is preferred that the preflush solution be applied to the contaminated surface by a method that produces the least amount of hazardous waste cleaning solution for disposal. Typically, a method of spraying a fine mist of the preflush solution onto the contaminated surface meets the requirement of minimizing the resultant amount of contaminated fluid for disposal.

In general, the preflush solution is allowed to dwell on the surface for a period of from about 10 to about 30 minutes, preferably about 17 minutes, before the application of the precleaning solution. The preflush solution need not be removed by rinsing or other means before the precleaning solution is applied. In other words, the precleaning solution may be applied on top of the preflush solution.

The invention process requires a first application of a precleaning fluid to a contaminated surface, removal of the precleaning fluid by rinsing with a solution of sodium citrate in substantially ion-free water or an aqueous rinse solution of 20 wt. % nitric acid and a non-ionic surfactant. This process may be repeated several times before an invention extraction fluid is applied.

The precleaning solution may be applied by any conventional means, including spraying by pressurized sprayer (as in an atomizer), pouring, scrubbing on, and like methods. To facilitate removal of loosely-held surface debris and contaminants, it is preferred that the precleaning solution be scrubbed onto the surface. In some instances, it is preferred to allow the precleaning fluid to dwell on the surface for a time sufficient to solubilize contaminants. After scrubbing and optional dwelling, the major portion of any surface-held debris or contaminants is removed along with the precleaning solution. The removal of the precleaning solution may be carried out by rinsing the surface with a rinse solution that is substantially ion-free water or a solution of sodium citrate in substantially ion-free water or, alternatively, with an aqueous solution of about 20 wt. % nitric acid (58% strength) and a non-ionic surfactant, preferably also including about 10 wt. % of a phosphate acid ester. Thereafter, the surface should be vacuumed to remove loose debris and contaminants in the rinse fluid.

The precleaned, rinsed, vacuumed, and dried surface is now suitable for receiving the extraction solution. The extraction solution may be applied by spraying with pressurized sprayers (atomizers), pouring, scrubbing on, and like methods or through circulation. Preferably, but not in all cases, the extraction solution is applied using a scrubbing technique. This ensures the removal and loosening of any further surface-held debris and contaminants while also facilitating the penetration of the fluid into the substrate through the pores, microscopic voids, and other surface irregularities in the surface. This penetration of the extraction fluid permits the leaching of contaminants from these surface irregularities and pores and microscopic voids so that deep extraction can be achieved.

The extraction stage is typically repeated several times and in each step the extraction fluid is allowed to dwell on the surface for at least about 1 to about 1.5 hours. Thus, in a typical clean-up process, extraction fluid is scrubbed onto the precleaned surface; allowed to dwell for about 1 to about 1.5 hours to allow leaching of contaminants from pores and other surface irregularities in which contaminants lodge; rinsed off with a rinse solution of substantially ion-free water or sodium citrate in substantially ion-free water or an aqueous solution of 20 wt. % nitric acid (58%) and a non-ionic surfactant (preferably also containing about 10 wt. % of a phosphate acid ester). The rinse solution is then vacuumed from the surface and the process is repeated by scrubbing extraction fluid onto the surface, etc. At the end of the working day, it is strongly preferred that the extraction fluid be scrubbed on and allowed to dwell on the surface overnight, i.e., for about 8 to about 13 hours. At least one such long dwell time is recommended. For especially heavily contaminated surfaces or porous surfaces, or surfaces with irregularities, it may be necessary to allow the extraction solution to dwell on the surface for a weekend—i.e., about 30 to about 60 hours. In general, a dwell time of between about 1 to about 100 hours is recommended, depending upon the nature of the surface, the type of contaminant, and the degree of contamination. When cleaning is recommenced in the morning after dwelling of extraction fluid on the surface overnight or over a weekend, then after rinsing off the extraction fluid and vacuuming off the rinse fluid, it is preferred that precleaning fluid is once again applied to the surface. After rinsing off the precleaning fluid and vacuuming the surface, the cycle of applying extraction fluid and dwelling of this fluid on the surface is recommenced, until the desired level of surface decontamination is achieved.

Clearly, the length of dwell time is dependent upon the surface being cleaned, the nature and concentration of contaminants being extracted and the ability to scrub the surface involved. The greater the degree of contamination and porosity of the surface or the more surface irregularities, the longer the required dwell time. A relatively smooth, lightly contaminated, pore-free surface, on the other hand, would require shorter dwell times. Preferably, the extraction fluid is allowed to dwell upon the surface at least once for a period of from about 8 to about 13 hours.

After a sufficient dwell time has elapsed to allow extraction of a significant portion of the contaminants, the surface is rinsed with a rinse solution and preferably vacuumed to remove surface fluids. Samples of the dry surface may then be tested to ascertain the concentration of residual contaminants. If the residual contaminant concentration is still unacceptably high, then the entire cleaning cycle, i.e., the application of both the precleaning and extraction fluids with necessary rinsing, dwell time, and vacuuming should be repeated until an acceptably low residual level of contaminants is achieved.

When the contaminant to be removed is heavy metals, the invention can remove up to about 90% of the contamination from a surface in a first application of the process steps. Each subsequent application of the invention process continues to remove up to about 90% of the then remaining contamination from the surface. Similarly, a first application of the invention method and fluids can result in a reduction of from about 70% to about 90% of the total radionuclide count. Each subsequent application of the invention process can continue to remove up to 70% to 90% of the then remaining contamination from the surface. When the contaminant is a pesticide or herbicide, the process can reduce residual levels to a level that meets TCLP standards (if it is a listed composition) or levels that are deemed acceptable (if it is not listed).

When the contaminant to be removed is PCBs, then the invention method can remove up to about 90% of the contamination from a surface in a first application of the process steps. Each subsequent application of the invention process can continue to remove up to about 90% of the then remaining contaminants. Through the multiple application of the invention process, the contaminants can be reduced to less than 10 μg/100 $cm^2$ (meeting the EPA's standard for reclassification as non-hazardous) or a level that is non-detectable (i.e., 0.2 μg/100 $cm^2$, or less), so that the cleaned equipment, apparatus, or other surface, meets the EPA guidelines for subsequent reuse, resale, or disposal as a non-hazardous material.

Further, the process allows the extraction of contaminants to a significant depth beneath a porous surface, such as concrete, brick, wood, and the like, without substantial surface destruction or scarring.

Once the desired level of decontamination has been achieved, any residual contaminants remaining in the substrate having a porous surface or surface with irregularities, may be sealed. This may be achieved by applying a chemical fixative such as liquid silica to the surface to encapsulate or coat the surface. Thereafter, a solution of a synthetic impermeable polymer may be applied to the surface by conventional techniques such as spraying, brushing, and the like. An especially preferred over coating is provided by applying a clear polyurethane solution to the cleaned surface.

Since the process utilizes precleaning fluid, rinsing fluids, and extraction fluids, these will become contaminated with the contaminant that is being removed from the surface. These contaminated fluids must then be disposed of in an environmentally acceptable manner. To minimize disposal costs, the quantity of these contaminated fluids should be minimized. Generally, the complete invention process requires a total of 6 gallons/100 $ft^2$ of surface cleaned, more typically, less than 7–8 gallons/100 $ft^2$. Thus, the process generates a relatively low amount of hazardous waste for disposal.

b. Particulate Cleaning

The invention process and cleaning fluids are also effective for removing contaminants from particulates, such as sand, clay, gravel, and the like. Preferably, the particulates are also treated in a cycle including the steps of precleaning, rinsing with a solution of sodium citrate in ion-free water or an aqueous solution of about 20 wt. % nitric acid and a non-ionic surfactant, extracting with extraction fluid, including dwelling of the fluid on particle surfaces, rinsing with substantially ion-free water or a solution of sodium citrate in substantially ion-free water, or a solution of about 20 wt. % nitric acid (58%) and a non-ionic surfactant (preferably also containing about 10 wt. % phosphate acid ester), and finally drying.

There are several methods for applying these treatment steps to particulates which may be effective. However, in one of the preferred embodiments, the particulates are accumulated in a hopper from which they are fed at a controlled rate onto a conveyor belt above which is suspended a series of spraying bars from which precleaning solution is sprayed onto the contaminated particulates as the belt moves under the bars. In this manner, the particulates are intimately contacted with precleaning solution. Thereafter, the precleaned particulates are sprayed with a rinsing solution. In a next stage, the particulates are sprayed with the extraction fluid which is preferably allowed to dwell on the particulates for a period of time sufficient to penetrate pores, microscopic voids, and thoroughly clean the particulate surface. This period of time may vary depending upon the type of particulate, but is generally in the range from about 2 to about 24 hours. After dwelling, the extraction fluid is rinsed with the rinsing solution. If, upon testing, the residual concentration of surface contaminants exceeds the level desired, the process steps may be repeated until the desired level is achieved. The rinsed particulates may then be dried by any suitable method.

In another embodiment, the invention cleaning fluids and rinsing solutions are not sprayed onto particulates on a conveyor belt, but rather, the particulates are intimately mixed with the fluids in tanks, preferably having cone-shaped bottoms. The particulate material in the tank is first slurried with precleaning fluid, preferably using an agitator rotating at low speeds to enable complete mixing and wetting of particulate surfaces. Thereafter, agitation is stopped and the particulates are allowed to settle. Precleaning solution is withdrawn and a rinsing solution is added to the precleaned particulates. Once again, the mixture of rinse solution and particulates is preferably agitated at low speeds. After rinsing, the rinse fluid is withdrawn and extraction fluid is added to the particulates, again preferably with slow agitation. After extraction has proceeded for a sufficient amount of time to remove contaminants from the particulates to a desired residual level, agitation is stopped and the cleaned particulates allowed to settle. Extraction fluid is then removed and rinse fluid is added to the particulates, preferably with agitation, to remove residual extraction fluid and contaminants from the particulate surfaces. After rinsing, the rinse fluid is removed and the particulates are discharged and conveyed to a means for drying. These means may include an oven, or may simply entail spreading the particulates in an open area for drying under sunlight and/or ambient conditions.

In certain circumstances, it may not be desirable to apply the precleaning fluid to the particulates. Under these circumstances, the extraction fluid alone may be used. Thus, in the first-described method, the particulates are sprayed with extraction fluid which is preferably allowed to dwell on the particulates for a period of time sufficient to penetrate pores, microscopic voids, and surface irregularities to thoroughly clean the particulate surface. Thereafter, the extraction fluid is rinsed from the particulates, preferably using a solution of sodium citrate in substantially ion-free water or an aqueous solution of about 20 wt. % nitric acid, about 10 wt. % phosphate acid ester, and a non-ionic surfactant. The steps of spraying with extraction fluid, dwelling, and rinsing with sodium citrate solution are repeated until the desired residual concentration of surface contaminants is reached. In the other embodiment, particulate material is slurried with extraction fluid, preferably with agitation at low speeds. After extraction has proceeded for a sufficient amount of time to remove contaminants from the particulates, agitation is stopped and the cleaned particulates allowed to settle. Extraction fluid is then removed and rinse fluid is added to the particulates, preferably with agitation, to remove residual extraction fluid and contaminants from the particulate surfaces. Thereafter, the particulates may be discharged and conveyed to a means for drying.

Other particulate handling methods may be used to clean the particulates, as long as the above-described steps of precleaning (optional), rinsing (optional), extracting and dwelling, and rinsing are substantially followed.

The Preflush Solution

The preflush solution according to the invention is an aqueous solution with a pH less than zero. The preflush solution facilitates the action of extraction and is optionally applied when the contaminant to be removed includes PCBs, organics, pesticides, radionuclides, or heavy metals.

In its most basic but useful form, the preflush solution comprises a strong oxidizing acid and a surfactant dissolved in deionized water. Thus, the solution includes about 20 wt. % nitric acid (58%) and about 1 wt. % of a non-ionic surfactant, all dissolved in deionized water. This solution is also useful as a rinse solution, as an alternative to the sodium citrate rinse solution.

In a preferred composition of the preflush solution, the solution contains a strong oxidizing agent, a phosphate acid ester, and a non-ionic surfactant, all dissolved in distilled water. A most preferred formulation of the preflush solution includes about 20 wt. % nitric acid (58%), about 10 wt. % of a phosphate acid ester (QSA-90), about 1.0 wt. % of a non-ionic surfactant (POE), and distilled water or substantially ion-free. Under certain conditions, a corrosion inhibitor may have to be added. These conditions may readily be determined by testing a portion of the surface with the preflush solution. Under certain conditions, hydrogen can be generated when the solution is applied to a surface.

The Precleaning Composition

The precleaning composition used in the invention is an aqueous fluid comprising several chemical compositions blended into substantially ion-free water. It is preferred that substantially ion-free water be used to prevent possible interference of ions typically present in water with the ions utilized by the precleaning fluid in its cleaning action.

The precleaning fluid includes compositions able to extract covalent cations from contaminated surfaces; acids that are useful as degreasers, and solubilizers of heavy metals; compositions that produce a chemical, such as hydrofluoric acid, for slightly etching the surfaces to be cleaned, including silica-containing surfaces; surfactants that act as wetting agents and that facilitate the flushing of contaminants from pores, microscopic voids, crevices, and other surface irregularities; chelating agents that fix solubilized metals and particulates into chemical complexes and that also remove stains; solvent cleaners that also act as detergents and degreasers; and optionally a composition that masks odors.

Preferably, the acid for the extracting of covalent cations, such as magnesium, calcium, and sodium, is sulfamic acid. Preferably, the composition that produces hydrofluoric acids which attacks and slightly etches surfaces to be cleaned, is hydrofluoric ammonium bifluoride. Preferably, the acid used as a degreaser is hydrochloric acid. Preferably, the surfactant is a non-ionic surfactant. More preferably, the non-ionic surfactant is polyethylene-oxylethanol. Preferably, the chelating agent of the precleaning fluid includes more than one chelant. Preferably one of the chelating agents is sodium citrate. More preferably, the chelating agents are sodium citrate and oxalic acid, the latter also acting as a stain remover, especially for iron oxide stains. Preferably, the solvent cleaner is triethanolamine which also acts as a water softener, dispersion agent, emulsifier, wetting agent, detergent, and degreaser. Optionally, an odor masking chemical may be added. Preferably, this odor masker is D-limonine which also acts as a degreaser.

Typically, the precleaning fluid comprises from about 4 to about 10 wt. % sulfamic acid, from about 5 to about 10 wt. % hydrofluoric ammonium bifluoride, from about 2 to about 6 wt. % 35% hydrochloric acid, about 1 to about 4 wt. % of a non-ionic surfactant, about 8 to about wt. % sodium citrate or citric acid, about 1 to about wt. % phosphate acid ester; about 1 to about 20 wt. % triethanolamine, and optionally, about 1 to about 2 wt. % d-limonine. The fluid may be prepared without triethanolamine which is used to adjust the pH.

In a preferred embodiment, the precleaning fluid comprises about 8 wt. % sulfamic acid, about 8 wt. % hydrofluoric ammonium bifluoride, about 5 wt. % 35% hydrochloric acid, about 1 wt. % non-ionic surfactant, about 12 wt. % sodium citrate or citric acid, about 2 to about 7 wt. % oxalic acid (more preferably 5 wt. %), up to about 10 wt. % triethanolamine, about 4 wt. % phosphate acid ester, and optionally, about 1 wt. % d-limonine.

In a most preferred embodiment, the precleaning fluid includes:

less than about 1 wt. % formic acid (85% strength), about 4 to about 10 wt. % sulfamic acid, about 5 to about 10 wt. % ammonium bifluoride (38% strength), about 1 to about 6 wt. % of a phosphate acid ester, about 6 to about 15 wt. % citric acid present as sodium citrate, about 1 to about 7 wt. % oxalic acid, about 1 to about 5 wt. % glycolic acid (also known as hydroxyacetic acid), about 1 to about 5 wt. % d-limonine as an optional deodorizer, about 2 to about 6 wt. % hydrochloric acid (35% strength), about 1 to about 20 wt. % triethanolamine (used to adjust the pH), about 1 to about 4 wt. % of a non-ionic surfactant (6–8 molar concentration), and distilled water.

For certain applications, a corrosion inhibitor may have to be added to the precleaning fluids to avoid damage to the contaminated surface. The surface may readily be tested for susceptibility by treating a small portion with the precleaning blend as a test measure. Additional amounts of the phosphate acid ester may have to be added at the end of process for making the precleaning fluid in order to couple (hydrotropic agent) the composition.

The Extraction Fluid

In order to clean any type of surface, including smooth surfaces, but especially those porous surfaces, surfaces of particulates, and irregular surfaces that are hard to clean because they retain contaminants in the substrate of the surface through the irregularities in the surface, the invention provides an extraction fluid, preferably applied to a dried surface after the precleaning fluid has been applied and vacuumed from the surface. This extraction fluid is water-based and is preferably prepared using substantially ion-free water, such as distilled water, demineralized water, and deionized water. The use of substantially ion-free water prevents the cleaning hindering interaction of ions typically present in a water supply with ions produced from the components of the extraction fluid.

The extraction fluid is a mixture of a range of components, each of which perform a function in the extraction operation. More specifically, the extraction solution includes a non-ionic surfactant; an emulsifier for emulsifying hydrocarbons from the contaminated surface; chelating agents for holding solubilized metal ions and particulates in suspension; degreasing agents for removing hydrocarbons from the contaminated surface; a hydrotropic agent for facilitating maintaining all ingredients in solution; and a wetting agent to facilitate wetting of the surface and pores and microscopic voids or crevices within the surface.

Preferably, the emulsifier contains quaternary amines, isopropyl alcohol, and glycerine, preferably EMULSIFIER FOUR™ of Exxon Chemical Co., although other emulsifiers are also suitable. Preferably, the chelant comprises at least two chelating agents. More preferably, these chelating agents are selected from ethylene diamine tetracetic acid (EDTA), nitrilotriacetic acid (NTA), 1,2 diamino-cyclohexane-tetracetic acid (CDTA), ethylene-bis (oxyethylene nitrilo)-tetracetic acid (EBTA), hydroxyethylenediamine (HEDTA), and sodium gluconate. Preferably, the degreaser is ethylene glycol monobutyl ether, although other degreasers may also be suitable. The hydrotropic agent is preferably of a type that also provides chemical buffering action to maintain pH. A preferred hydrotropic agent is sold under the tradename QSA-90 by Texaco Chemical Corp. A preferred wetting agent, that also serves as a solvent and degreaser is triethanolamine, although other wetting agents are also useful.

Preferably, the extraction fluid includes from about 5 to about 8 wt. % of a non-ionic surfactant; from about 4 to about 8 wt. % of an emulsifier, preferably an emulsifier containing quaternary ammonium, isopropyl alcohol, and glycerine; about 10 to about 20 wt. % ethylene diamine tetracetic acid; about 5 to about 12 wt. % ethylene glycol monobutyl ether; about 3 to about 8 wt. % of a hydrotropic agent; and about 3 to about 8 wt. % triethanolamine.

In a most preferred embodiment, the extraction fluid is formulated as follows:

about 5 to about 8 wt. % of a non-ionic surfactant (preferably alkephenolethoxylate), about 1 to about 5 wt. % of a phosphate acid ester (such as QSA-90™), about 4 to about 9 wt. % of an emulsifier, about 15 to about 20 wt. % EDTA (VERSENE-100 of Dow Chemical), about 4 to about 15 wt. % of a composition selected from the group consisting of nitrolotriacetic acid, gluconic acid, CDTA, EBTA, and HEDTA (VERSENOL-120 of Dow Chemical); about 5 to about 12 wt. % ethylene glycol monobutyl ether, about 4 to about 8 wt. % triethanolamine, about 1 to about 5 wt. % propylene glycol, about 1 to about 5 wt. % triethylamine, about 1 to about 10 wt. % kerosene (deodorized), about 1 to about 5 wt. % trimethylamine, and distilled water. In order to assist hydrotropic agent formation, additional phosphate acid ester may be added at the end of the process of blending the fluid. In order to increase the pH to greater than about 11.5, potassium hydroxide is added. D-limonine may be added optionally for odor control.

The following example is intended to illustrate the invention and does not in any way limit the invention as described above and claimed below.

EXAMPLE

During late 1992, the invention process was utilized in a test to demonstrate effectiveness by decontaminating a 3,000 sq. ft. area in an unclassified area at a nuclear weapons production plant. This area was contaminated with PCBs up to the level of 10,000 micrograms/100 $m^2$, heavy metals registering above 1,000 milligrams per liter, and enriched uranium registering above 80,000 DPM. The contaminated concrete pad was approximately 40 years old and the contaminants extended to several inches of its depth.

As a first step, the concrete pad was swept clean to remove any loose surface debris. Thereafter, a precleaning fluid of the invention was applied by scrubbing onto the surface. This precleaning fluid was then rinsed with a solution of sodium citrate in substantially ion-free water and then vacuumed. The precleaning and rinsing step was then repeated. Thereafter, the rinsed, vacuumed, and precleaned surface was allowed to dry. An invention extraction fluid was then applied to the dried, precleaned surface by scrubbing. The extraction fluid was allowed to dwell on the surface for approximately 1–3 hours, then removed by rinsing with a solution of about 8 wt. % sodium citrate in substantially ion-free water and then vacuumed. The steps of scrubbing with an extraction fluid, dwelling, rinsing off of the solution, and then vacuuming was carried out approximately 2–3 times per day for 4 days. At the end of each day, an extraction fluid was applied by scrubbing onto the surface and was allowed to dwell overnight. The following morning, the extraction fluid was rinsed off the surface with a solution of about 8 wt. % sodium citrate in substantially ion-free water and then vacuumed. Thereafter, precleaning fluid was applied by scrubbing onto the surface. The precleaning fluid was then rinsed and vacuumed from the surface and extraction fluid applied by scrubbing onto the rinsed surface. Once again, the cycle of applying extraction fluid, allowing the fluid to dwell on the surface, rinsing, and vacuuming the extraction fluid was repeated during the day. This process continued for a total of four days and three nights.

At the end of the fourth day, the weekend approached and the extraction fluid was applied by scrubbing and allowed to dwell on the surface over the 2-day weekend. The following Monday morning, the precleaning fluid was rinsed and vacuumed from the surface with a solution of sodium citrate in substantially ion-free water. The surface was then allowed to dry and samples were taken to determine the level of residual contaminant on the cleaned surface.

The results of sampling and testing indicated that residual PCBs had been reduced to less than 10 micrograms/100 $cm^2$ (in most cases, less than 0.2 micrograms/100 $cm^2$); heavy metals had been reduced to levels better than the TCLP standard set by the EPA, and radionuclides had been reduced to less than 2,000 DPM. For this particular application, the radionuclide concentration was regarded as acceptable.

The foregoing disclosure and description of the invention are illustrative and explanatory thereof, and various changes in the composition and process may be appreciated by one of ordinary skill in the art that do not depart from the scope and spirit of the invention described above and claimed below.

I claim:

1. An extraction fluid effective for the removal of contaminants from the surfaces and the underlying substrates of such surfaces, the surfaces including smooth surfaces, porous surfaces, surfaces of particulates, and surfaces with irregularities; the extraction fluid comprising:

from about 5 to about 8 wt. % of a non-ionic surfactant; from about 4 to about 8 wt. % of an emulsifier comprising quaternary ammonium; from about 10 to about 20 wt. % of a chelant; from about 5 to about 12 wt. % ethylene glycol monobutyl ether; from about 1 to about 5 wt. % triethylamine; and from about 6 to about 16 wt. % of a hydrotropic agent;

whereby said extraction fluid is able to penetrate into pores, microscopic voids and crevices of porous surfaces and into surface irregularities to remove contaminants.

2. The extraction fluid of claim 1 further comprising:

from about 1 to about 5 wt. % propylene glycol; from about 1 to about 5 wt. % trimethylamine; and from about 1 to about 10 wt. % kerosene.

3. The fluid of claim 1, wherein the hydrotropic agent comprises about 50 wt. % triethanolamine.

4. The fluid of claim 1, wherein the chelant is selected from the group consisting of: ethylene diamine tetracetic acid, nitrilotriacetic acid, 1,2 diamnio-cyclohexane-tetracetic acid, gluconic acid, ethylene-bis (oxyethylene nitrilo)-tetracetic acid, hydroxyethylene-diamine, and sodium gluconate.

5. The fluid of claim 1, wherein about 50 wt. % of the hydrotropic agent comprises a phosphate acid ester.

6. An aqueous extraction fluid effective for removal of contaminants from surfaces and underlying substrates of such surfaces, the surfaces including smooth surfaces, irregular surfaces, and particulate surfaces; the extraction fluid comprising:

from about 5 to about 8 wt. % of a non-ionic surfactant; from about 4 to about 9 wt. % of an emulsifier comprising quaternary ammonium effective for emulsifying hydrocarbons; from about 10 to about 20 wt. % of a chelating agent for holding solubilized metal ions and particulates in suspension; from about 5 to about 12 wt. % ethylene glycol monobutyl ether; from about 3 to about 8 wt. % triethanolamine; from about I to about 5 wt. % triethylamine; and from about 3 to about 8 wt. % of a hydrotropic agent, the agent also providing chemical pH buffering activity;

whereby said extraction fluid is able to penetrate into pores, microscopic voids and crevices of porous surfaces and into surface irregularities to remove contaminants.

7. The fluid of claim 6, wherein the hydrotropic agent with chemical pH buffering action comprises a phosphate acid ester.

8. The fluid of claim 6, wherein the chelating agent is selected from the group consisting of ethylene diamine tetracetic acid, nitrilotriacetic acid, 1,2 diamnio-cyclohexame-tetracetic acid, gluconic acid, ethylene-bis (oxyethylene nitrilo)-tetracetic acid, hydroxyethelene-diamine, and sodium gluconate.

9. An aqueous extraction fluid effective for the removal of contaminants from surfaces and substrates of such surfaces, including porous surfaces, surfaces of particulates, and surfaces with irregularities; the aqueous extraction fluid comprising the following components in a blend with demineralized water:

(a) from about 9 to about 17 wt. % of a surfactant;

(b) about 10 to about 20 wt. % of a chelating agent;

(c) from about 5 to about 12 wt. % ethylene glycol monobutyl ether as a degreasing agent;

(d) from about 3 to about 8 wt. % of a hydrotropic agent, the agent also effective as a pH buffering agent;

(e) from about 1 to about 5 wt. % triethylamine; and (f) from about 3 to about 8 wt. % triethanolamine as a wetting agent;

whereby said extraction fluid is able to penetrate into pores of porous surfaces and into surface irregularities to remove contaminants.

10. The fluid of claim 9, wherein the hydrotropic agent that is also effective as a pH buffering agent is present in an amount from about 1 to about 5 wt. %.

11. The fluid of claim 10, wherein the hydrotropic agent that is also effective as a pH buffering agent is a phosphate acid ester.

12. The fluid of claim 9 further comprising:

from about 1 to about 5 wt. % propylene glycol; and from about 1 to about 10 wt. % kerosene.

13. The fluid of claim 9, further comprising D-limonine in a sufficient quantity to control odor.

14. The extraction fluid of claim 9, wherein the chelating agent is selected from the group consisting of ethylene diamine tetracetic acid, nitrilotriacetic acid, 1,2 diamnio-cyclohexanetetracetic acid, gluconic acid, ethylene-bis (oxyethylene nitrilo)-tetracetic acid, hydroxyethylenediamine, and sodium gluconate.

15. The fluid of claim 9, wherein the about 9 to about 17 wt. % of a surfactant comprises from about 5 to about 8 wt. %, based on the mass of the extractive fluid, of a non-ionic surfactant.

16. The fluid of claim 9, wherein the about 9 to about 17 wt. % of a surfactant comprises from about 4 to about 9 wt. %, based on the mass of the extractive fluid, of an emulsifier comprising quaternary ammonium.

* * * * *